US007617849B2

(12) United States Patent
Dubois et al.

(10) Patent No.: US 7,617,849 B2
(45) Date of Patent: Nov. 17, 2009

(54) APPARATUS AND METHOD FOR DISPENSING SUBSTANCES INTO CONTAINERS

(75) Inventors: Alain Dubois, Vincennes (FR); Damien Dupont, Lognes (FR); Ivan-William Fontaine, Nogent sur marne (FR); Patrick Herbelin, Pommeuse (FR); Denis Loisel, Vincennes (FR); Didier Plier, Hautefeuille (FR); Bertrand Stefani, Grisy Suisnes (FR)

(73) Assignee: Mettler-Toledo AG, Greifensee (CH)

( * ) Notice: Subject to any disclaimer, the term of this patent is extended or adjusted under 35 U.S.C. 154(b) by 602 days.

(21) Appl. No.: 11/315,629

(22) Filed: Dec. 23, 2005

(65) Prior Publication Data

US 2006/0137760 A1 Jun. 29, 2006

(30) Foreign Application Priority Data

Dec. 23, 2004 (EP) ..... 04293116

(51) Int. Cl.
*B65B 1/30* (2006.01)

(52) U.S. Cl. ..... 141/83; 141/165; 141/250; 141/269; 414/225.01; 81/3.32

(58) Field of Classification Search ..... 141/83, 141/94, 98, 129, 130, 165, 181, 192, 250, 141/269; 414/222.01, 225.01, 749.1, 753.1, 414/910; 422/104; 81/3.07, 3.09, 3.31, 3.32; 177/60, 118; 73/64.56, 863.01; 53/179, 53/79

See application file for complete search history.

(56) References Cited

U.S. PATENT DOCUMENTS 5,038,839 A 8/1991 Morimoto et al.
5,337,794 A * 8/1994 Nishiyama et al. ..... 141/144
5,544,683 A 8/1996 Guhl
6,161,422 A * 12/2000 Thomas et al. ..... 73/38
6,674,022 B2 1/2004 Fermier et al.
7,028,726 B2 * 4/2006 Feygin et al. ..... 141/144
7,141,213 B1 * 11/2006 Pang et al. ..... 422/65

(Continued)

FOREIGN PATENT DOCUMENTS

EP 0 408 822 A2 1/1991

(Continued)

OTHER PUBLICATIONS

European Search Report dated Jun. 23, 2005.

*Primary Examiner*—Timothy L Maust
*Assistant Examiner*—Jason K Niesz
(74) *Attorney, Agent, or Firm*—Buchanan Ingersoll & Rooney PC

(57) ABSTRACT

An apparatus for dispensing substances, specifically powders and liquids, into a container, is designed as a compact module containing a weighing device with a load receiver, a holder device which is attached to the load receiver and serves to receive and loosely hold the container while the substances are dispensed into the container, and a liquid-dispensing device for dispensing a liquid into the container while the latter is seated in the holder device. The apparatus includes a clamping device for firmly gripping and immobilizing the container, so that a capping device that is not part of the apparatus can put a cap on the container or remove the cap from the container while the latter is seated in the holder device.

25 Claims, 6 Drawing Sheets

U.S. PATENT DOCUMENTS

| | | | | |
|---|---|---|---|---|
| 2001/0040324 | A1 * | 11/2001 | Mayama et al. | 267/136 |
| 2005/0072488 | A1 * | 4/2005 | Rouanet et al. | 141/12 |

FOREIGN PATENT DOCUMENTS

| | | | |
|---|---|---|---|
| EP | 0 869 346 | A2 | 10/1998 |
| FR | 2 610 111 | A1 | 7/1988 |
| WO | 94/25347 | A1 | 11/1994 |
| WO | 02/090896 | A2 | 11/2002 |

* cited by examiner

APPARATUS AND METHOD FOR DISPENSING SUBSTANCES INTO CONTAINERS

RELATED APPLICATIONS

This application is based on and claims priority to European Application No. 04293116.2, filed Dec. 23, 2004, the entire content of which is hereby incorporated by reference.

BACKGROUND INFORMATION

An apparatus as well as a method are disclosed for dispensing substances, specifically powders and liquids, from a delivery device into a recipient container, particularly into a test tube while the container is resting on the load receiver of a weighing device, specifically a balance. The weighing device can weigh the container for example before and after the dispensing of the substance and/or continuously during the dispensing of the substance into the container. After the substance or substances have been dispensed into the container, the latter may be closed with a cap.

An automated laboratory system is also disclosed that includes an apparatus or works according to a method consistent with the foregoing general description.

An apparatus and method for transferring and weighing powder materials is described in U.S. Pat. No. 6,674,022 B2. A robotic handling system uses a vacuum to draw a quantity of powder from a source container into a pipette-like transfer device, then moves the transfer device to a recipient container on a balance and drops the powder into the recipient container by switching off the vacuum and/or applying a small amount of pressure to the transfer device. The delivery of powder may include several transfers of partial quantities. The weight of the container is continuously monitored to automatically terminate the powder transfer when the target weight has been reached.

An automatic gravimetric sample-processing system for radioactive substances such as plutonium is described in FR 2 610 111 A1. Arranged inside a glove box, the system includes a sampling device, a diluting device, an electronic balance, and a remote-controlled robot arm. In the normal operating cycle, the robot arm picks up an empty recipient vessel from a turntable and places it on the balance, where the tare weight of the empty vessel is determined. The sampling device takes a sample of a liquid substance to be tested and adds it to the vessel on the balance which performs another weighing to determine the weight of the substance sample. Next, the diluting device adds a diluent to the sample in the container on the balance. After the balance has weighed the diluted sample in the container, the latter is returned to the turntable which then advances the container to a stirring device.

A fill-weighing system for a pharmaceutical production line is disclosed in EP 0 408 822 A2. Empty vessels such as vials or ampoules arriving on a conveyor device are weighed on a first balance, from where they are transferred to a filling machine to be filled with a powdery or liquid product. The filled containers are transferred to a second balance to determine or verify the correct fill weight, whereupon the filled containers leave the system to proceed to further process steps down the line. A very similar fill-weighing system is also described in U.S. Pat. No. 5,038,839.

With regard to the concepts of adding an inert gas and closing the container with a cap, a method and apparatus for sealing containers with food products such as fruit juice under an inert gas atmosphere are described in WO 94/25347 A1. Before capping, the container is put in an enclosed environment where the air is removed and an inert gas is added. Consequently, any space that is not occupied by product will be filled out by the inert gas.

In spite of their merits for the specific applications that they were proposed and designed for, the aforementioned known devices fail to address certain requirements that occur especially in the field of laboratory automation. In particular, each of the aforementioned known devices for dispensing substances into containers is designed to work in a set mode and to perform a specific task but lacks the adaptability that is required for automated laboratory applications, in particular the capability to work with a laboratory robot.

SUMMARY

The present invention therefore has the objective to provide an apparatus for dispensing substances, particularly liquids and/or powders, into containers, which is configured as a module that can operate as a part of an automated laboratory system, particularly with a robot, and which is flexibly adaptable and expandable to perform additional functions.

A method is also disclosed for dispensing substances involving the use of the inventive apparatus.

An automated laboratory system is disclosed in which the inventive dispensing apparatus cooperates with a laboratory robot.

An apparatus for dispensing substances, specifically liquids and powders, into a container, particularly into a test tube that can be closed with a cap, includes a weighing device with a load receiver. Attached to the load receiver is a holder device that serves to receive the container from a handling device and loosely hold the container while the substances are being dispensed into the container. The apparatus further includes a dispensing device for dispensing the substances into the container while the container is seated in the holder device. According to the invention, the apparatus is distinguished in particular by a clamping device which is likewise arranged inside the housing and can be activated to firmly grip and immobilize the container, so that an external capping device which is not part of the apparatus per se can put a cap on the container or remove the cap from the container while the container is seated in the holder device. As a further distinguishing feature of the invention, the apparatus is configured as a compact module with a housing that contains at least the weighing device, the holder device, and the clamping device. The holder device holds the container in a position where only the top ends of the holder device and of the container with a fill opening protrude through a window in the top surface of the apparatus housing. The window has sufficient clearance from the holder device and/or the container to avoid any contact that would interfere with the weighing of the container on the weighing device.

An exemplary embodiment including a clamping device in the dispensing apparatus has several advantages, particularly in applications where the containers are closed with a cap after a substance has been dispensed into them by the apparatus according to the invention. Putting a cap on a container such as a test tube or a flask generally requires the use of two human hands or, analogously, two mechanical devices of an automated laboratory system. One hand, or a manipulating device such as a robotic arm, serves to pick up a cap from a cap storage device and to push or screw the cap on the container, while the other hand or a clamping device serves to keep a firm grip on the container, counteracting the force or torque applied by the first hand or by the manipulating device when putting the cap on the container. With the apparatus according to the invention, this capping operation can be performed in an automated system without having to move the container from a dispensing/weighing device to a separate clamping device in order to put on a cap. While simplifying the system and saving space, the inventive concept of integrating the clamping device in the dispensing apparatus also minimizes the time interval between dispensing and capping. This is a particularly important consideration if the dispensed substance is, e.g., a volatile liquid that gives off toxic vapors, or if the dispensed substance is hygroscopic substance, or if it interacts in any other ways with the ambient atmosphere. Also, capping the container before picking it up and moving it to another location reduces the risk of spilling the dispensed substance in case of a system malfunction or operator error.

In preferred embodiments of the inventive apparatus, the holder device has lateral window openings and the clamping device has jaws that contact and grip the container through the lateral window openings while the capping device puts the cap on the container or removes the cap from the container. In a rest position of the clamping device, the jaws are retracted from the container and the holder device so that they don't interfere with the weighing of the container on the weighing device.

Preferably, the holder device has a resilient attachment to the load receiver and mechanical stops that limit the movement of the holder device, so that the weighing device is protected from vertical extraneous forces other than a weight within a range that can be measured by, or is at least not harmful to, the weighing device.

In a preferred arrangement according to the invention, the module of the foregoing description is mounted by itself on a freestanding pedestal in order to isolate the sensitive weighing system as much as possible from mechanical shocks and vibrations.

In an advantageous embodiment of the invention, the apparatus of the foregoing description is further equipped with a suction device for drawing off vapors given off from volatile substances as they are being dispensed into the container while the latter is seated in the holder device on the load receiver of the weighing device.

An exemplary apparatus according to the invention can further include a gas-delivery device for dispensing an inert gas into the container while the latter is seated in the holder device on the load receiver of the weighing device. This embodiment is particularly advantageous if the substance dispensed is a hygroscopic substance, or if it interacts in any other ways with the ambient atmosphere, as the inert gas will form a barrier between the substance in the container and the ambient atmosphere.

In an advantageous embodiment of the apparatus, the liquid-dispensing device and/or the suction device and/or the gas-delivery device is arranged in a substantially horizontal dispenser arm and includes orifices or dispensing tips at the end of conduits that are connected to sources of liquid and/or powder, vacuum and inert gas. The dispenser arm is movable vertically up and down as well as rotatable about a vertical axis, so that the arm can move between a working position where the dispensing tips are lowered into the container that is seated in the holder device and a parked position where the arm is moved out of the way to allow access to the container from above. The dispenser arm is moved to the parked position to provide access to a device that is not part of the inventive apparatus for example a handling device that places a container in the holder device and removes the container from the holder device, or a further powder-delivery device of a powder delivery module that dispenses a powdery or granular substance into the container, or the aforementioned capping device which can put a cap on the container or remove a cap from the container.

Advantageous embodiments of the inventive apparatus may further include an ionizing device for ionizing the atmosphere surrounding the container while the latter is seated in the holder device in order to prevent a build-up of static charges on the container which could cause weighing errors due to electrostatic static forces acting on the container.

The apparatus according to the invention may further include a barcode reader for reading bar-coded information that may be affixed to the container.

In advantageous embodiments of the inventive apparatus, the aforementioned devices such as the weighing device, the clamping device, the liquid-dispensing device and/or powder delivery device, the gas-delivery device, the suction device, the dispenser arm and/or the barcode reader perform their respective functions under the command of a control device such as a laboratory computer which simultaneously controls external devices that cooperate with the inventive apparatus, such as the aforementioned handling device, and/or the capping device, an/or the further powder delivery device of the powder delivery module, that may work as an alternative or an additional powder delivery device.

The scope of the invention further includes a method for dispensing substances, specifically powders and liquids, into a container, particularly into a test tube that can be closed with a cap. The method has the following principal steps:

A handling device such as, e.g., a laboratory robot picks up a container from a holding rack and puts the container into a holder device that is supported on the load receiver of a weighing device. A liquid-dispensing device or a powder-delivery device is moved to a position above the container, and a liquid or powder is delivered into the container either by volume as determined by the delivery device, or by weight as determined by the weighing device. The inventive method is in particular distinguished by the fact that a capping device seals the container by pushing or screwing a cap onto the container while the latter is still seated in the holder device and that during the capping operation the container is immobilized and held in a firm grip by a clamping device. Subsequently, the clamping device releases its grip on the container, and the handling device removes the container from the holder device.

The scope of the invention includes in particular any method that includes the use of the inventive apparatus in any of the embodiments described herein.

An automated laboratory system according to the invention includes in particular the apparatus of the foregoing description in any of the embodiments described herein.

In the automated laboratory system, the apparatus according to the invention would typically cooperate with a laboratory robot which may be equipped and programmed to perform functions such as transporting the container to and from the inventive apparatus module as well as picking up a cap and pushing or screwing it onto the container while the latter is held in a firm grip by the clamping device. The automated laboratory system may further include a powder-dispensing module that serves to dispense powdery or granular substances from a suitable delivery device into the container while the latter is seated in the holder device of the inventive apparatus.

DESCRIPTION OF THE DRAWINGS

Preferred embodiments of the invention will be further described below with reference to the drawings, wherein.

DETAILED DESCRIPTION

Figure 1:
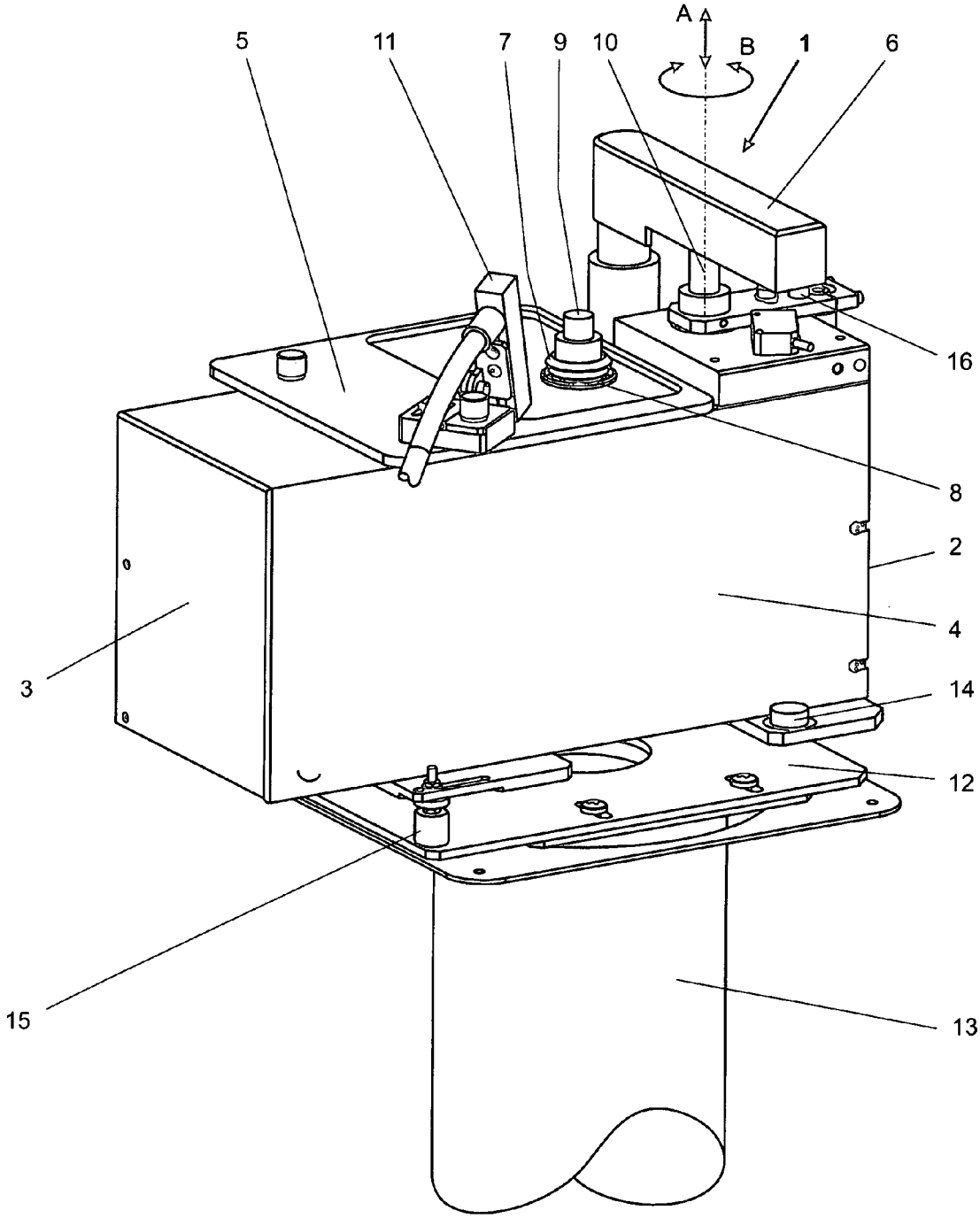
FIG. 1 represents a schematically simplified perspective view of the dispensing apparatus according to an exemplary embodiment of the invention.

FIG. 1 shows a schematically simplified perspective view of a preferred embodiment, where the inventive apparatus 1 is configured as a compact module with a substantially box-shaped apparatus housing 2 with one end wall 3, one sidewall 4, and a top surface 5 facing the viewer. The dispenser arm 6 is shown in the parked position, so that the top of the holder device 7 which protrudes from the window opening 8 in the top surface 5 is accessible for example to allow a robot arm (not shown) to grip the top of the test tube 9 (shown protruding from the holder device 7) and to lift it out and remove it from the apparatus 1. The dispenser arm 6, driven by an actuator device (not shown) inside the housing 2, can move up and down (arrow A) as well as swivel (arrow B) on its support post 10. An ionizing device 11 is arranged on top of the housing 2 to ionize the ambient air surrounding the test tube 9 in the holder device 7 and thereby to prevent the accumulation of electrostatic charges on the test tube 9 and holder device 7. The apparatus 1 rests or is mounted on a mounting plate 12 supported by a freestanding pedestal column 13 which stands directly on the floor, independent of other parts of an automated laboratory system 101 (see FIG. 4) that includes the inventive apparatus 1 as one of its components. Shocks and vibrations originating from the other parts of the system 101 are thus prevented from propagating directly to the sensitive weighing device 22 (see FIG. 2) inside the housing 2. As the apparatus contains the weighing device 22, it is equipped in the customary manner with a spirit level 14 and level-adjusting feet 15 (only one of which is shown in the drawing).

Figure 2:
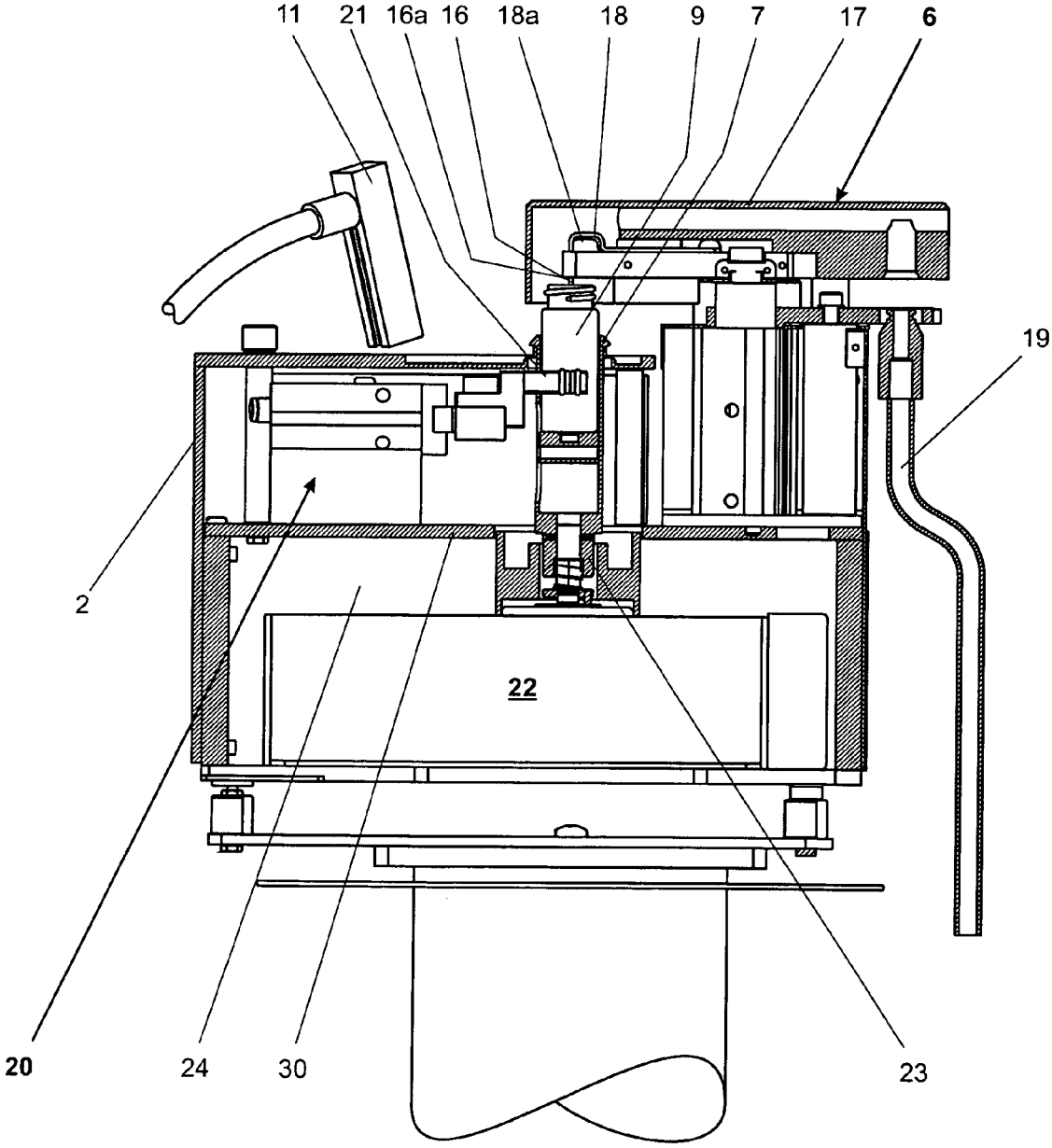
FIG. 2 represents the apparatus of FIG. 1 with one sidewall removed and the dispenser arm swiveled over the sample container.

FIG. 2 represents a side view of the same embodiment as shown in FIG. 1, with the side wall 4 taken off. The reference symbols used in FIG. 1 are likewise applicable to FIG. 2. The dispenser arm 6 is shown in the working position. From the parked position shown in FIG. 1, the dispenser arm 6 has been swiveled over the test tube 9 and then moved downwards so that a liquid-dispensing tip 16 and/or a gas-delivery orifice 16*a* in the dispenser arm 6 is lowered to its dispensing position in the test tube 9. The dispenser arm 6 contains inside a dispenser arm housing 17 a connector conduit 18 from the flexible liquid-supply conduit to the liquid-dispensing tip 16. In addition to the dispensing tip 16 and the connector conduit 18 which serve to deliver liquid to the test tube 9, the dispenser arm 6 can also be equipped with a gas-delivery orifice 16*a*, connector conduit for gas 18*a* and a flexible gas-supply conduit (not shown) to deliver an inert gas, for example argon, to the test tube 9. The purpose of the inert gas is to separate the substance in the test tube 9 from the ambient atmosphere, for example to prevent the substance from absorbing moisture or from oxidizing. At least in the area above the test tube 9, the dispenser arm housing 17 is open at the bottom so that it covers the top of the test tube 9 like a fume hood. At the opposite end from the dispenser tips 16, 16*a*, the dispenser arm housing is connected to a suction conduit 19 to remove any vapors that may be given off by substances in the test tube 9.

Also shown in FIG. 2 is the clamping device 20 with one of the clamping jaws 21 extending in front of the holder device 7. The weighing device 22 is arranged in a separate weighing device compartment 24 which is partitioned by a horizontal plate 30 from the rest of the interior of the apparatus housing 2. The horizontal plate 30 has an opening in the area where the holder device 7 is seated on the load receiver 23 of the weighing device 22.

Figure 3A:
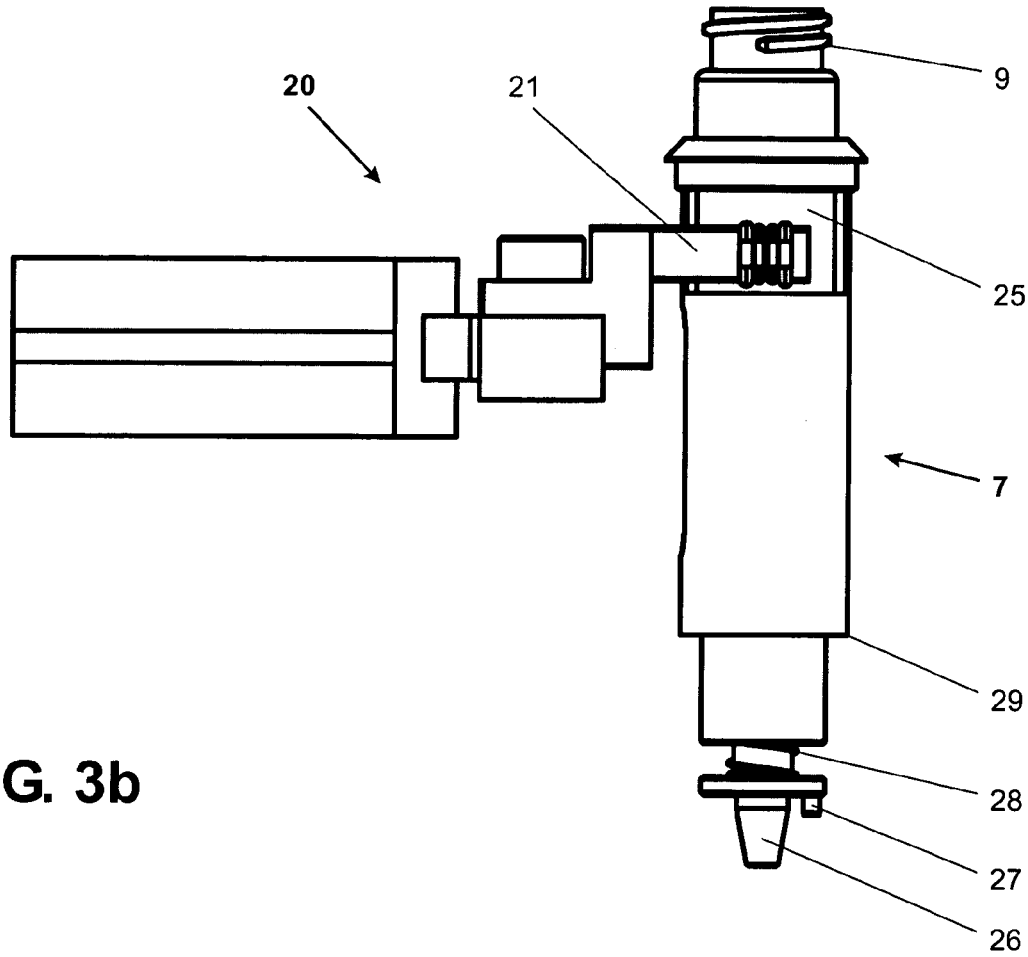
FIG. 3*a* represents a side view of the clamping device and the holder device of FIG. 2.

FIG. 3*a* shows the clamping device 20 and the holder device 7 with a test tube 9 in an enlarged detail view seen from the same direction as in FIG. 2. The clamping jaws 21 (one of which is visible) grip the test tube 9 through windows 25 (one of which is visible) in the holder device 7. As further illustrated in FIG. 3*a*, the bottom of the holder device 7 is configured as a seating cone 26 with a locator pin 27 fitting into matching recesses of the load receiver 23 of the weighing device 22. Also visible in FIG. 3*a* is an overload spring 28. Under an overload or other excessive downward force, the holder device 7 moves downward towards the seating cone 26 against the spring force of the overload spring 28 until the step 29 of the holder device 7 comes to rest on the rim of the opening in the horizontal plate 30 (see FIG. 2).

Figure 3B:
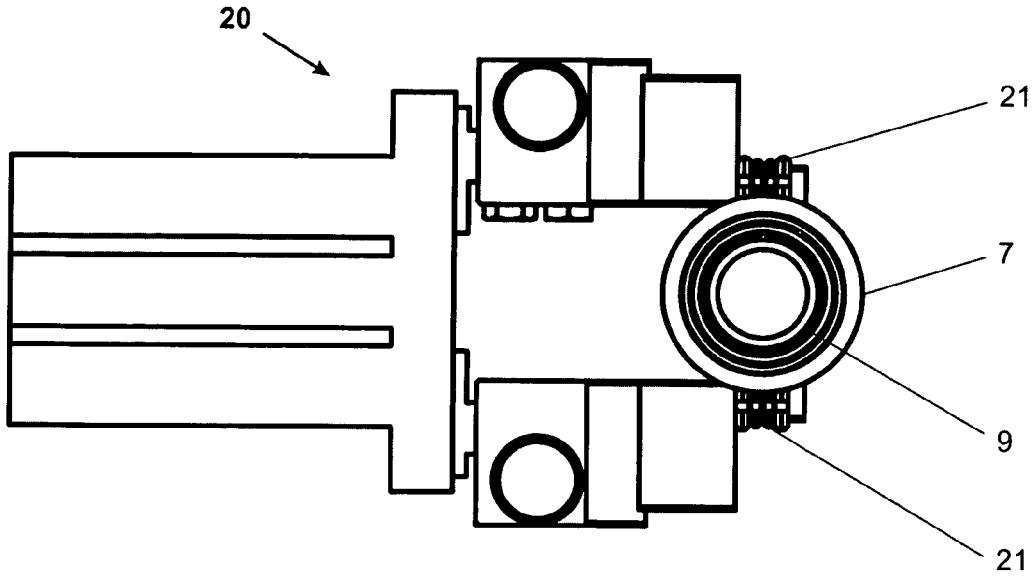
FIG. 3*b* represents a top view of the clamping device and the holder device of FIG. 2.

FIG. 3*b* illustrates the clamping device 20 and the holder device 7 with a test tube 9 in a top view that shows how the clamping jaws 21 grip the test tube 9 from both sides through the window openings 25 (which are not visible in the top view of FIG. 3*b*).

Figure 4:
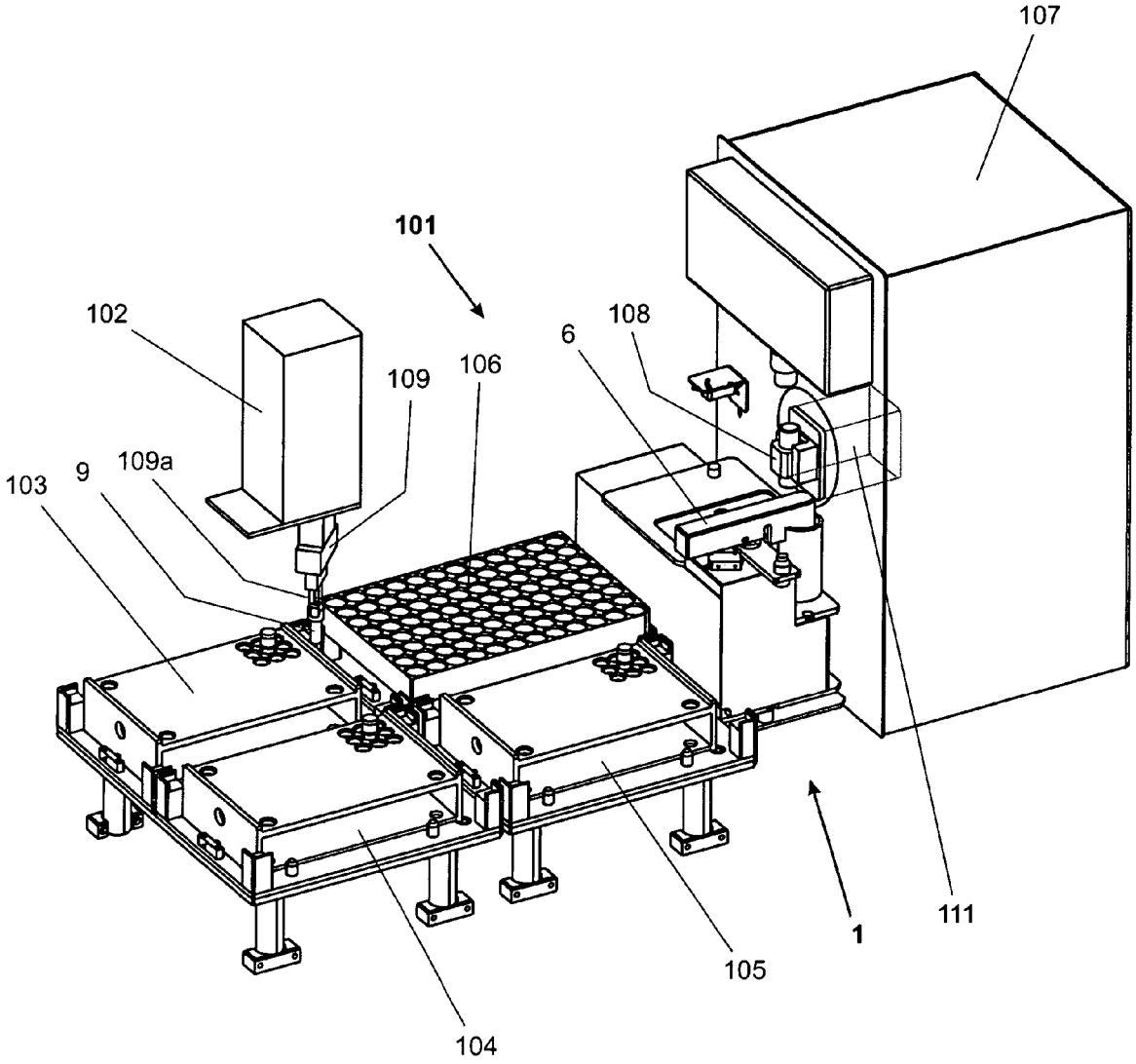
FIG. 4 represents a schematic top view of an automated laboratory system that includes the dispensing apparatus according to an exemplary embodiment of the invention.

FIG. 4 illustrates the inventive dispensing apparatus 1 functioning as a part of an automated laboratory system 101 which in addition to the dispensing apparatus module 1 includes a robot (of which only the robot arm 102 is shown) holding a test tube 9, storage racks 103, 104, 105, 106, and a powder-delivery module 107 holding a powder container 108. The storage racks 103, 104, 105, 106 can be configured to hold, e.g., empty and filled test tubes 9, powder containers 108, and container caps 110 (see FIG. 5). The robot arm 102 moves in the x-, y-, and z-direction of a Cartesian coordinate system, while the gripper portion 109 with the gripper jaws 109*a* (shown in detail in FIG. 5) is also capable of rotating about its vertical axis, for example to put a screw cap 110 on a container 9.

Figure 5A:
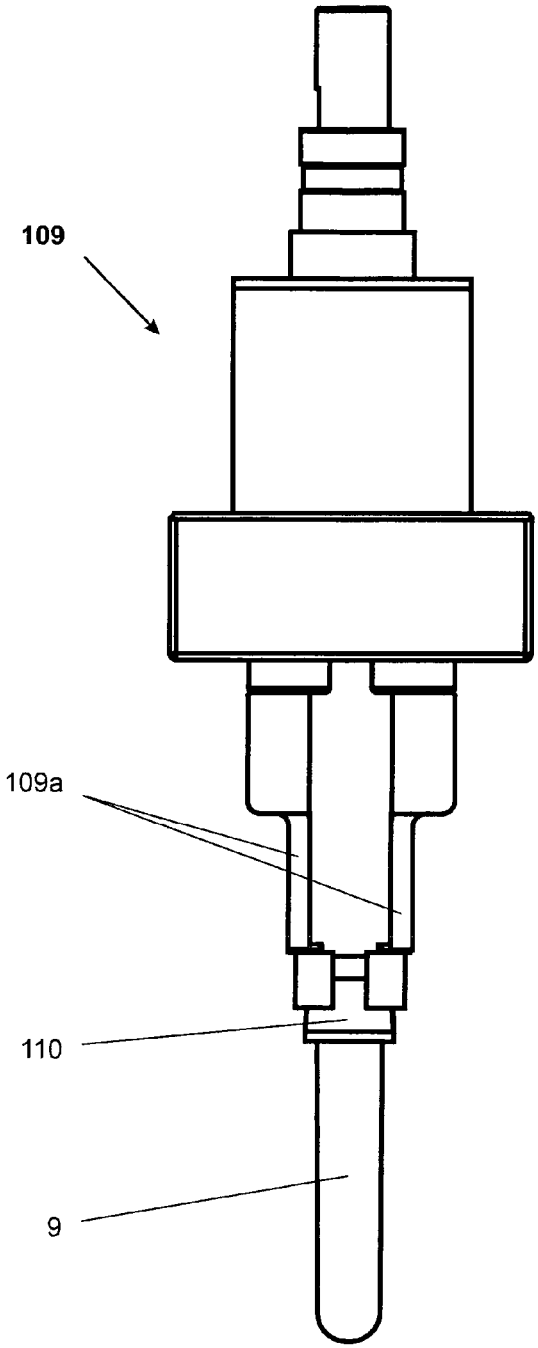
FIG. 5*a* represents a detail of FIG. 4 in a first side view.
Figure 5B:
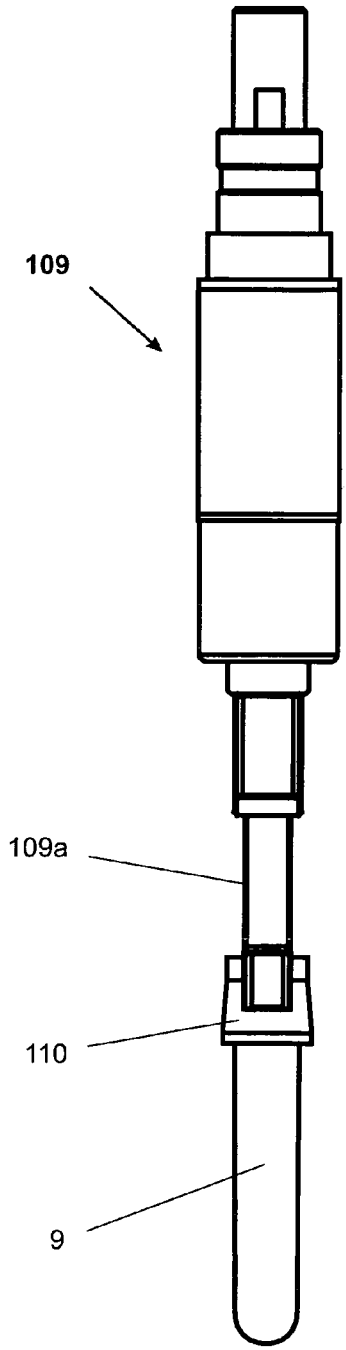
FIG. 5*b* represents a detail of FIG. 4 in a second side view.

FIGS. 5*a* and 5*b* illustrate the working end of the robot arm 102 of FIG. 4 showing in particular the gripper portion 109 with the jaws 109*a* in the process of screwing a cap 110 onto a test tube 9.

Figure 6:
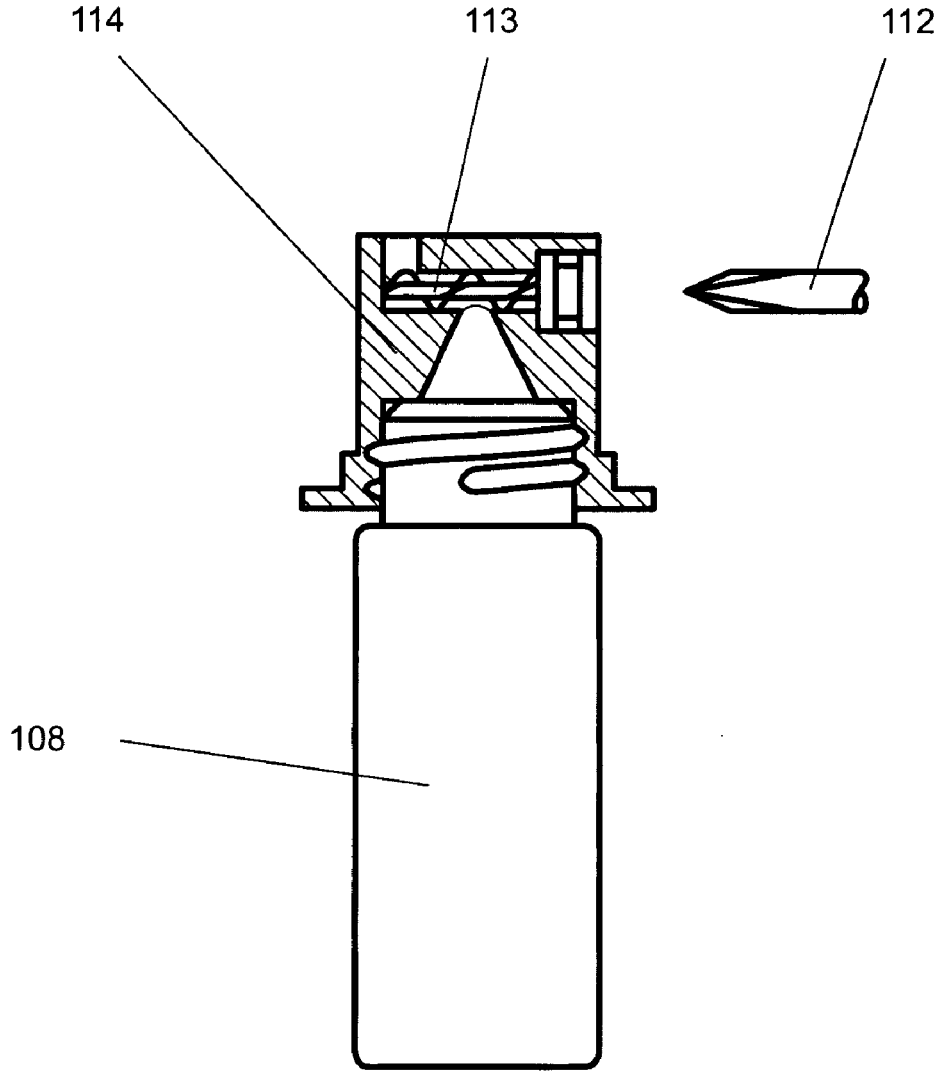
FIG. 6 represents a powder container with a dispensing head suitable for use in the automated laboratory system of FIG. 4.

FIG. 6 illustrates a powder container 108 that is designed to be handled by the powder-dispensing module 107 which has a manipulating device 111 (see FIG. 4) to handle powder containers 108 that are for example designed in accordance with FIG. 1 (reproduced herein as FIG. 6) of International PCT Application WO 02/090896, owned by the same assignee as the present application. The powder-dispensing operation can be summarized as follows:

1. The robot arm 102 brings a powder container 108 to the powder-dispensing module 107.
2. The manipulating device 111 of the powder-dispensing module 107 grips the powder container 108 and puts it in the proper position so that the screwdriver 112 can engage the Archimedean feed screw device 113 in the dispensing head 114 of the powder container 108.

3. The manipulating device 111 moves the powder container 108 into a position above the test tube 9 (not visible in FIG. 4) that is seated in the holder device 7 (not visible in FIG. 4) of the inventive apparatus module 1.

4. The manipulating device 111 turns the powder container 108 upside down.

5. The screwdriver 112 turns the feed screw device 113, thereby dispensing powder into the test tube 9.

The apparatus and method of the present invention have been described and illustrated in preferred configurations. However, guided by the teachings of the invention, persons of ordinary skill in the art will be able to realize further embodiments. In particular, the apparatus could be designed to have further capabilities and perform functions in addition to those that are expressly described and claimed. For example, the apparatus could also include the powder-dispensing device which, in the configuration described herein, is configured as a separate module.

The invention claimed is:

1. Dispensing apparatus for dispensing a substance, into a container, said apparatus comprising:

a weighing device with a load receiver;

a holder device which is attached to the load receiver and serves to receive a container and loosely hold the container while a substance is dispensed into the container;

a dispensing device for dispensing said substance into the container while the container is seated in the holder device; and a clamping device for firmly gripping and immobilizing the container to receive a cap on the container or to remove the cap from the container while the container is seated in the holder device, the apparatus being configured as a compact module with a housing inside of which at least the weighing device, the clamping device and the holder device are arranged in such a manner that only a top of the holder device and a top portion of a container seated in the holder device protrude through a window opening in a top surface of the housing; wherein the holder device has lateral window openings and the clamping device has jaws that contact and grip the container through said lateral window openings while a capping device or a robot arm puts the cap on the container or removes the cap from the container.

2. Apparatus according to claim 1, wherein the apparatus comprises:

a suction device for drawing off vapors given off by substances in the container, while the container is seated in the holder device.

3. Apparatus according to claim 1, wherein the apparatus comprises:

a gas-delivery device for delivering an inert gas to the container, while the container is seated in the holder device.

4. Apparatus according to claim 1, wherein said dispensing device is a liquid-dispensing device arranged in a dispenser arm and comprises:

a liquid-dispensing tip connected to a liquid-supply conduit which, in turn, is connected to a source of liquid, wherein the dispenser arm is movable vertically up and down as well as rotatable about a vertical axis, between a working position where the liquid-dispensing tip is lowered into the container and a parked position where the dispenser arm is moved away to allow access to the container from above.

5. Apparatus according to claim 3, wherein said gas delivery device is arranged in a dispenser arm and comprises:

a gas-delivery orifice connected to a gas supply conduit which, in turn, is connected to a source of inert gas, and wherein the dispenser arm is movable vertically up and down as well as rotatable about a vertical axis, between a working position where the gas-delivery orifice is lowered into the container and a parked position where the arm is moved away to allow access to the container from above.

6. Apparatus according to claim 1, wherein said apparatus is mounted by itself on a freestanding pedestal column in order to minimize an influence of mechanical shocks and vibrations on the weighing device.

7. Apparatus according to claim 1, wherein one or more of the devices of the apparatus are controllable by a control device.

8. Apparatus according to claim 1, in combination with a handling device from which the holder device receives a container, wherein said handling device comprises:

a robot arm of a laboratory robot operable to bring said container to the apparatus, place the container into the holder device, and remove the container from the holder device.

9. Apparatus according to claim 1, in combination with a capping device which puts a cap on a container, wherein said capping device comprises:

a robot arm of a laboratory robot operable to put the cap on the container and/or remove the cap from the container (9) while the container is seated in the holder device.

10. Apparatus according to claim 1, wherein the holder device has a resilient attachment to the load receiver in order to protect the weighing device from overloads and harmful forces caused by the capping and/or uncapping of the container while the container is seated in the holder device.

11. Apparatus according to claim 1, wherein the apparatus is adapted to cooperate with a powder-dispensing module that delivers powder to the container while the container is seated in the holder device.

12. Apparatus according to claim 1, wherein the apparatus comprises an ionizing device for ionizing the atmosphere surrounding the container while the container is seated in the holder device in order to prevent a build-up of electrostatic charges on the container.

13. Apparatus according to claim 1, wherein the apparatus comprises a barcode reader for reading a barcode that is affixed to the container.

14. Automated laboratory system wherein the system includes a dispensing apparatus for dispensing a substance, into a container, said apparatus comprising:

a weighing device with a load receiver;

a holder device which is attached to the load receiver and serves to receive a container and loosely hold the container while a substance is dispensed into the container;

a dispensing device for dispensing said substances into the container while the container is seated in the holder device; and a clamping device for firmly gripping and immobilizing the container to receive a cap on the container or to remove the cap from the container while the container is seated in the holder device, the apparatus being configured as a compact module with a housing inside of which at least the weighing device, the clamping device and the holder device are arranged in such a manner that only a top of the holder device and a top portion of a container seated in the holder device protrude through a window opening in a top surface of the housing; wherein the holder device has lateral window openings and the clamping device has jaws that contact and grip the container through said lateral window openings while a capping device or a robot arm puts the cap on the container or removes the cap from the container.

15. Automated laboratory system according to claim 14, wherein the dispensing apparatus, in combination with a handling device, during operation, performs the functions of:

controlling the handling device to pick up a container from a storage rack and place the container into a holder device that is supported on a load receiver of a weighing device;

moving the dispensing device, formed as a liquid-dispensing device or a powder-delivery device, to a position above the container, and delivering a liquid or powder into the container either by volume as determined by the delivery device, or by weight as determined by the dispensing device;

controlling a capping device to place a cap on the container; and controlling the handling device to remove the container from the holder device, wherein the capping device seals the container by pushing or screwing the cap onto the container while the container is still seated in the holder device, and wherein during a capping operation the container is immobilized and held in a firm grip by a clamping device.

16. Apparatus according to claim 1, for dispensing powders and/or liquids into a test tube that is closeable with a cap.

17. Apparatus according to claim 2, wherein the apparatus comprises:

a gas-delivery device for delivering an inert gas to the container, while the container is seated in the holder device.

18. Apparatus according to claim 17, wherein said dispensing device is a liquid-dispensing device arranged in a dispenser arm and comprises:

a liquid-dispensing tip connected to a liquid-supply conduit which, in turn, is connected to a source of liquid, wherein the dispenser arm is movable vertically up and down as well as rotatable about a vertical axis, between a working position where the liquid-dispensing tip is lowered into the container and a parked position where the dispenser arm is moved away to allow access to the container from above.

19. Apparatus according to claim 18, wherein said apparatus is mounted by itself on a freestanding pedestal column in order to minimize an influence of mechanical shocks and vibrations on the weighing device.

20. Apparatus according to claim 19, in combination with a handling device from which the holder device receives a container, wherein said handling device comprises:

a robot arm of a laboratory robot operable to bring said container to the apparatus, place the container into the holder device, and remove the container from the holder device.

21. Apparatus according to claim 20, in combination with a capping device which puts a cap on a container, wherein said capping device comprises:

a robot arm of a laboratory robot operable to put the cap on the container and/or remove the cap from the container while the container is seated in the holder device.

22. Apparatus according to claim 21, wherein the holder device has lateral window openings and the clamping device has jaws that contact and grip the container through said lateral window openings while the capping device or a robot arm puts the cap on the container or removes the cap from the container.

23. Apparatus according to claim 22, wherein the holder device has a resilient attachment to the load receiver in order to protect the weighing device from overloads and harmful forces caused by the capping and/or uncapping of the container while the container is seated in the holder device.

24. Apparatus according to claim 23, wherein the apparatus comprises an ionizing device for ionizing the atmosphere surrounding the container while the container is seated in the holder device in order to prevent a build-up of electrostatic charges on the container.

25. Apparatus according to claim 24, wherein the apparatus comprises a barcode reader for reading a barcode that is affixed to the container.

* * * * *